US005156477A

United States Patent [19]

Hasegawa

[11] Patent Number: 5,156,477

[45] Date of Patent: Oct. 20, 1992

[54] MOVABLE PLATEN TYPE RECORDING APPARATUS

[75] Inventor: Takeshi Hasegawa, Yokohama, Japan

[73] Assignee: Canon Kabushiki Kaisha, Tokyo, Japan

[21] Appl. No.: 846,772

[22] Filed: Mar. 9, 1992

Related U.S. Application Data

[63] Continuation of Ser. No. 666,440, Mar. 11, 1991, abandoned, which is a continuation of Ser. No. 328,703, Mar. 27, 1989, abandoned, which is a continuation of Ser. No. 39,289, Apr. 17, 1987, abandoned.

[30] Foreign Application Priority Data

Jul. 15, 1986 [JP] Japan ..... 61-166447
Jul. 15, 1986 [JP] Japan ..... 61-166448

[51] Int. Cl.[5] ..... B41J 11/00

[52] U.S. Cl. ..... 400/649; 400/693; 400/613.1

[58] Field of Search ..... 400/613.1, 648, 647, 400/690.4, 691, 692, 693; 346/145, 146

[56] References Cited

U.S. PATENT DOCUMENTS

| | | | |
|---|---|---|---|
| 1,521,952 | 1/1925 | Holmyard | 400/355 X |
| 3,548,746 | 12/1970 | Hepp | 400/616.1 X |
| 3,572,601 | 3/1971 | Miller | 400/618 X |
| 3,586,149 | 6/1971 | Miller | 400/618 |
| 3,905,462 | 9/1975 | Nowak | 400/660 |
| 4,300,844 | 11/1981 | Keil | 400/120 |
| 4,423,631 | 1/1984 | Dold | 346/145 X |
| 4,437,404 | 3/1984 | Barbour | 101/269 |
| 4,444,522 | 4/1984 | Suyuki et al. | 400/618 X |
| 4,462,702 | 7/1984 | Fritz et al. | 400/649 X |
| 4,507,963 | 4/1985 | Donner et al. | 346/145 X |
| 4,641,980 | 2/1987 | Matsumoto et al. | 400/120 |
| 4,642,659 | 2/1987 | Nagashima et al. | 400/120 X |
| 4,642,661 | 2/1987 | Dean, II | 346/145 X |
| 4,701,593 | 10/1989 | Hiramatsu | 346/76 PH X |
| 4,772,146 | 9/1988 | Saito et al. | 400/649 |

FOREIGN PATENT DOCUMENTS

| | | | |
|---|---|---|---|
| 144181 | 11/1981 | Japan | 101/93.92 |
| 83689 | 5/1984 | Japan | 400/660 |
| 59-35410 | 9/1984 | Japan | 400/120 |
| 32678 | 2/1985 | Japan | 400/358 |

OTHER PUBLICATIONS

IBM Tech. Disc. Bulletin, "Easy Remove Platen", Irving, vol. 21, No. 9, Feb. 1979, pp. 3696-3697.

*Primary Examiner*—David A. Wiecking
*Attorney, Agent, or Firm*—Fitzpatrick, Cella, Harper & Scinto

[57] ABSTRACT

A recording apparatus includes a recording apparatus body including a sheet feeding roller and recording means for effecting recording on a sheet, platen means mounted for movement to an opened position and a closed position relative to the recording apparatus body, adapted in the closed position to press the sheet against the roller and adapted in the opened position to liberate the sheet from the roller, and a bar member fixed to the platen means so as to extend through the platen means to reinforce the platen means and having one end thereof supported by the recording apparatus body so that the platen means is movable.

10 Claims, 8 Drawing Sheets

MOVABLE PLATEN TYPE RECORDING APPARATUS

This application is a continuation of application Ser. No. 666,440, filed Mar. 11, 1991, which is a continuation of application Ser. No. 328,703, filed Mar. 27, 1989, which is a continuation of application Ser. No. 039,289, filed Apr. 17, 1987, all now abandoned.

BACKGROUND OF THE INVENTION

1. Field of the Invention

This invention relates to a recc rding apparatus in which a platen for supporting a recording medium is movable.

2. Related Background Art

Generally, in a recording apparatus, a platen is disposed in opposed relationship with a recording head, and to effect recording, recording paper must be inserted between the platen and the recording head. To insert the recording paper therebetween, the paper is inserted, for example, into a paper insertion port provided at the rear of the apparatus while depressing a feed switch or the like. However, if the leading edge of the paper is forced into the insertion port, the leading edge of the paper may sometimes not be properly nipped between feed rollers in the apparatus and thus, insertion of the paper has been very cumbersome.

A recording apparatus as shown in FIG. 1 of the accompanying drawings has been proposed (this apparatus is disclosed in Japanese Utility Model Publication No. 35410/1984). In FIG. 1, reference numeral 1 designates a roll sheet contained in the recess of a paper case 8. The paper drawn out from the roll sheet 1 is guided to a printing head 6 via a guide 9. Above the roll sheet 1, a paper cover 2 is provided for rotation about a shaft 4. This paper cover has a portion thereof providing a platen portion opposed to the printing head 6, and also has a tension roller 3 adapted to be urged against a feed roller 5 provided in the guide 9.

In the construction described above, when the paper is to be set between the platen portion 2*a* and the printing head 6, the paper cover 2 may first be opened in the direction of arrow a to set the roll sheet 1 in the paper containing portion 8, and the paper may be drawn out from the roll sheet 1 and placed onto the feed roller 5 and the printing head 6, and finally the paper cover 2 may be closed in the direction of arrow b. However, even this example of the prior art suffers from the following disadvantage.

In the recording apparatus of this type according to the prior art, particularly when the platen unit is in its opened position, if a force is suddenly applied from outside the platen unit, the platen supporting portion of the printer (recording apparatus) body will be deformed or damaged under an excessively great force This has led to the possibility of serious trouble.

Particularly, if an object falls onto the apparatus or the operator's hand suddenly touches the apparatus during the operation thereof, an excessively great force acts in a vertical direction and therefore, a large-scale reinforcing structure has been necessary to accommodate this force.

SUMMARY OF THE INVENTION

It is an object of the present invention to provide a movable platen type recording apparatus which facilitates and ensures the loading of a recording sheet.

It is another object of the present invention to effectively prevent deformation or damage of the platen supporting portion of the recording apparatus body even when a vertical extraneous force is applied to the apparatus in the opened position of the platen.

It is still another object of the present invention to provide a recording apparatus in which sheet loading in the opened position of the platen can be accomplished smoothly.

Other objects of the present invention will become apparent from the following detailed description when read in conjunction with the accompanying drawings.

DESCRIPTION OF THE PREFERRED EMBODIMENTS

FIGS. 2 to 7 show a first embodiment of the present invention.

Figure 1:
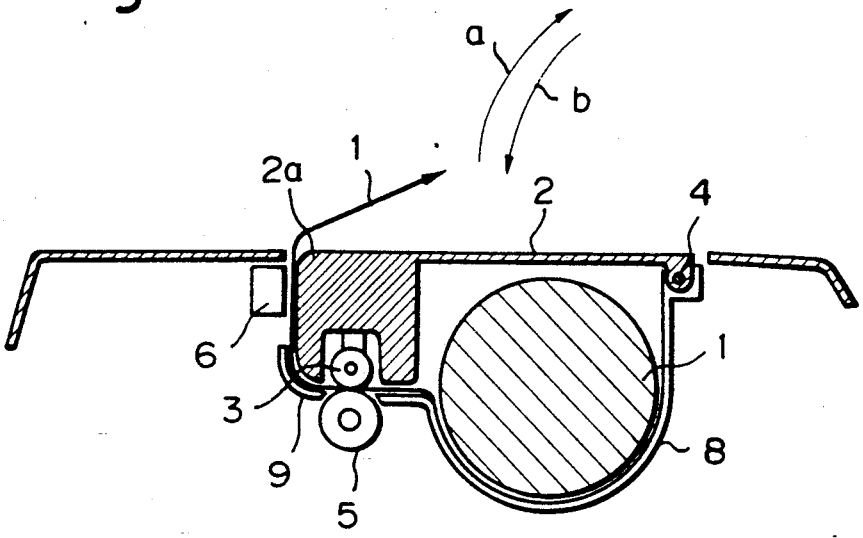
Fig. 1 PRIOR ART
FIG. 1 is a cross-sectional view of a movable platen type recording apparatus according to the prior art.
Figure 2:
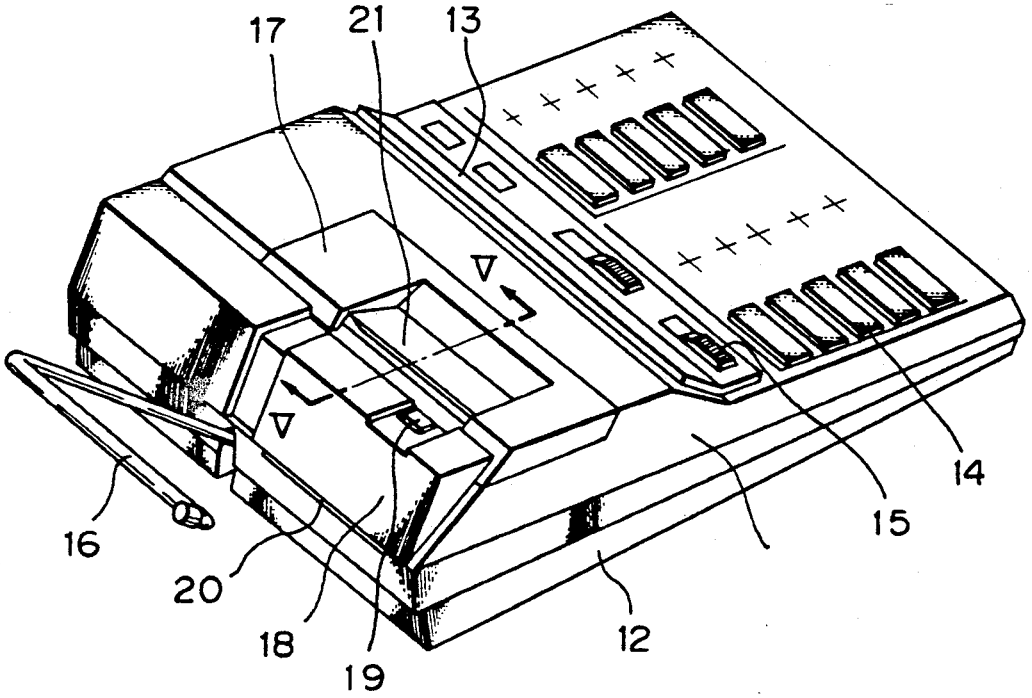
FIGS. 2 to 7 show a first embodiment of the present invention, FIG. 2 being a perspective view illustrating an electronic desk top calculator with a printer, FIG. 3 being a perspective view of a printer contained in the calculator of FIG. 2, FIG. 4 being a perspective view of the platen cover of FIG. 3 as seen from the back thereof, FIG. 5 being a cross-sectional view showing the coupling portion between the platen and the platen cover along line V—V of FIG. 2, FIG. 6 being a perspective view showing a reinforcing bar member and the support means therefor, and FIG. 7 schematically showing a force which acts on the bar member.

FIG. 2 shows the appearance of an electronic desk top calculator with a printer to which the present invention is applied.

Referring to FIG. 2, a case is comprised of an upper case portion 11 and a lower case portion 12. A display window 13, an operating key 14 and a slide switch 15 are provided on the upper case portion 11.

A printer (a recording apparatus) is contained in the case on the inside of the calculator, and a roll sheet holder 16 for holding a roll sheet as recording paper is mounted on the side surface of said case.

A printer lid 17 and a platen cover 18 which are openable relative to the upper case portion 11 are provided at a location which covers said printer. The platen cover 18 is mounted on a platen so as to cover the platen which backs up the sheet in a printing station as will be described later.

Figure 3:
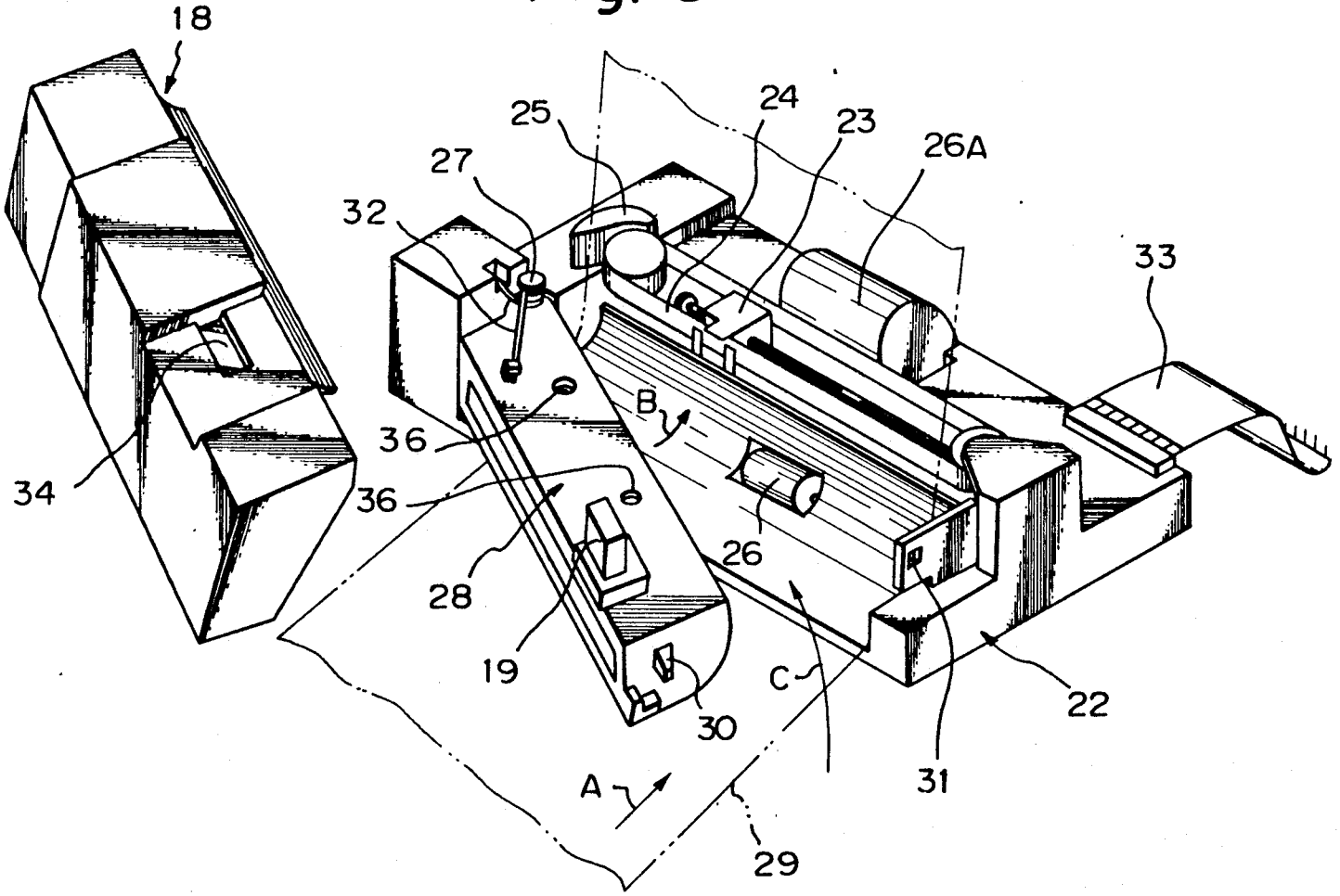

A switch 19 for releasing a platen lock is provided on the upper surface of the platen 28 (FIG. 3).

A roll sheet (not shown) held by the roll sheet holder 16 may pass through a sheet insertion port 20 and pass through the printer, whereafter it may be taken out from a sheet removal port formed by a sheet cutter (a paper cutter) 21 provided on the upper surface of the printer lid 17 and the platen cover.

FIG. 3 shows the printer contained in the electronic desk top calculator with a printer.

Referring to FIG. 3, a printing hammer 23 movable widthwisely of the sheet, a type belt 24 driven widthwisely of the sheet by pulleys at the opposite ends, an ink roll 25 for supplying ink to the type belt, a sheet feeding roller 26 and a drive motor 26A for driving these are mounted on the printer body 22.

The platen 28 is openably-closably supported on the printer body 22 by means of a platen supporting pin 27. FIG. 3 shows the platen 28 in its opened state, and the platen may be moved in the direction of arrow B in FIG. 3, whereby it may be closed and set to its usable state.

A pinch roller (not shown) urged against the sheet feeding roller 26 in the closed position of the platen 28 is mounted on the platen 28.

A sheet (in the illustrated example, a roll sheet) 29 may be inserted in the direction of arrow C from the opened end of the platen 28 by opening the platen 28, whereafter it may be set by closing the platen 28.

The platen 28 is provided with a lock pawl 30 operated by the release switch 19 (FIGS. 2 and 3), and on the other hand, the printer body 22 is formed with an engagement hole 31 engaged by the lock pawl 30 to hold the platen 28 in its closed position The platen 28 is normally biased in its opening direction by a return spring 32 mounted near the platen supporting pin 27, and is adapted to automatically open by the lock pawl 30 being retracted by the release switch 19 in the closed position of the platen.

Printing on the sheet 29 is accomplished by driving and pressing the printing hammer 23 toward the sheet 29 against the force of a return spring (not shown) when the printing hammer 23 is aligned with a predetermined type on the printing belt 24. This printing operation is controlled by a CPU, and a lead wire 33 for control and drive is connected to the printer body 22.

The platen cover 18 (FIGS. 2 and 3) is attached to the platen 28.

Figure 4:
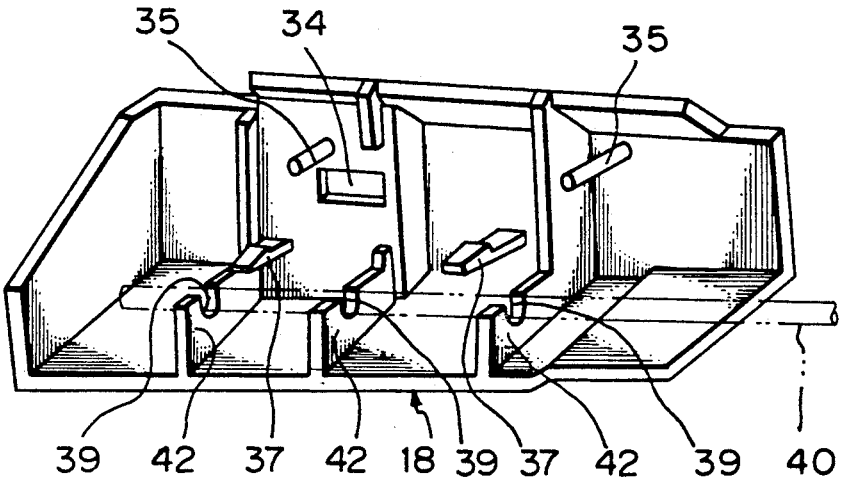
Figure 5:
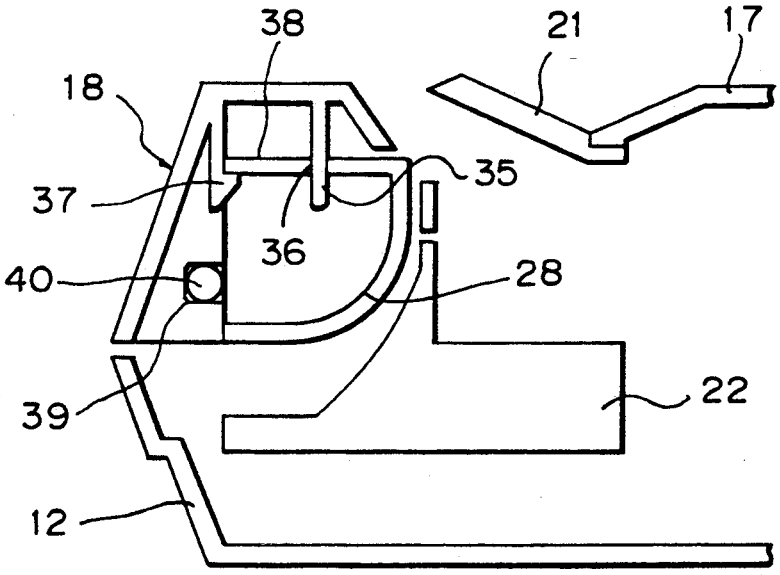

FIG. 4 is a view of the platen cover 18 as it is seen from its back, and FIG. 5 is a cross-sectional view showing the attached state of the platen cover 18 along line V—V of FIG. 2.

In FIGS. 3 and 4, an opening 34 through which the platen lock release switch 19 may protrude outwardly is formed in the upper surface of the platen cover 18.

Positioning projections 35 and 35 are formed on the back of the platen cover 18 as shown in FIG. 4, and platen cover positioning holes 36 and 36 into which these projections 35 and 35 are inserted are formed in the upper surface of the platen 28 as shown in FIG. 3.

Further, resilient hook pawls 37 and 37 for effecting the positioning of the projections 35, 35 and positioning holes 36, 36 in the direction of insertion are formed on the back of the platen cover 18.

The attachment of the platen cover 18 to the platen 28 may be accomplished by inserting the positioning projections 35 and 35 into the platen cover positioning holes 36 and 36 as shown in FIG. 5 to thereby regulate the degree of freedom in any other direction than the direction of insertion of the positioning projections, and further inserting the positioning projections 35 and 35, and causing the hook pawls 37 and 37 to be restrained by the flange portion 38 of the platen 28 to thereby fix the positioning projections at predetermined positions.

Figure 6:
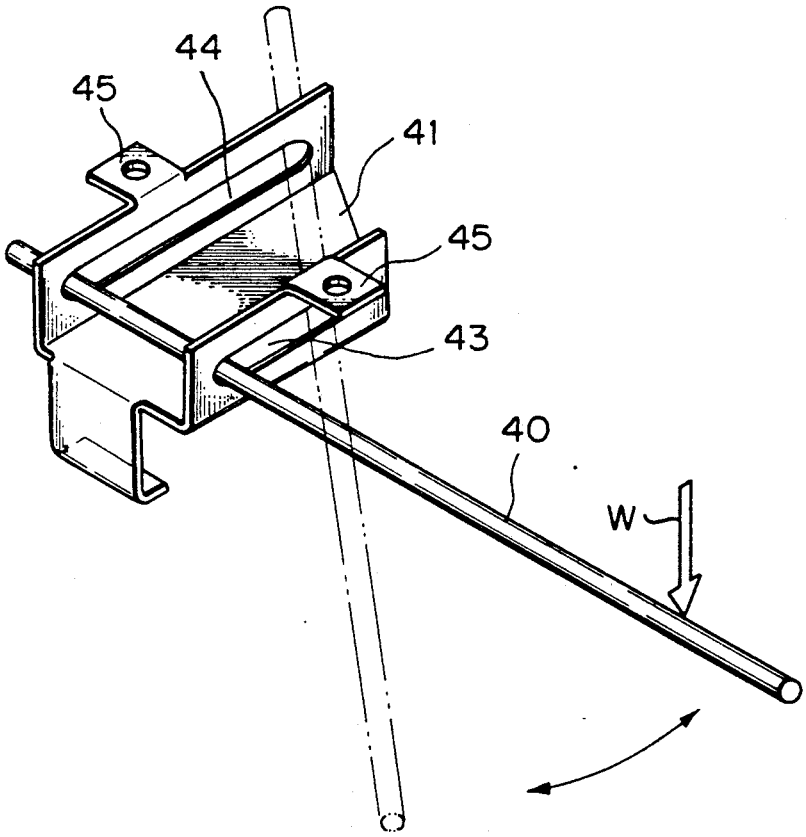

Thus, according to the present embodiment, a structure is adopted in which a bar member 40 is inserted into holes or recesses 39, 39, 39 (FIGS. 4 and 5) formed in the inner side of the platen cover 18 and said bar member is supported by support means 41 (FIG. 6) which is a metal fitting fixed to the interior of the upper and lower case portions 11 and 12 of the calculator. FIG. 6 shows the bar member 40 and the support means 41.

Referring to FIGS. 4 to 6, the bar member (usually a metal bar) 40 is inserted in the substantially U-shaped cut-away-like holes 39, 39, 39 formed in the end surfaces of ribs 42 formed at three locations on the inner side of the platen cover 18.

This bar member 40 is connected in a predetermined positional relationship while being interposed between the platen cover 18 and the platen 28 by assembling the platen cover to the platen after the bar member has been inserted into the holes 39 in the platen cover 18, as shown in FIG. 5.

Thus, the bar member 40 has its other end portion inserted in the lengthwise holes 43 and 44 in said support means (usually a metal support) as shown in FIG. 6 while it is interposed and positioned between the platen cover 18 and the platen 28.

The holes 43 and 44 each have a straight portion of a width substantially equal to the thickness of the bar member 40, and differ in length from each other.

Also, the support means (metal support) 41 is fixed to a predetermined location inside the upper case portion 11 by a screw, a bolt or the like through flanges 45 and 45 having mounting holes.

The bar member 40, as described above, is inserted in the holes 39 formed in the ribs 42 formed on the back of the platen cover 18, and is supported (i.e. cantilevered) with its other end portion inserted in the holes 43 and 44 of the support means 41 which is fixed to the upper case portion 11.

That is, the assembly of the platen 28 and the platen cover 18 openably-closably supported relative to the printer body 22 is supported by a structure in which all or part of any extraneous force applied to the assembly is supported by the bar member 40.

In FIG. 6, the bar member 40 is positioned by being inserted in the holes 39 of the platen cover 18, and may be moved relative to the metal support 41 fixed to the upper case portion by opening and closing the platen 28.

Therefore, the lengths of the aforementioned lengthwise holes 43 and 44 for support formed in the metal support 41 are set in accordance with the range of said relative movement. Accordingly, the bar member 40 has a degree of freedom in the direction of said relative movement relative to the support means 41, but is restricted in movement in a direction perpendicular thereto, and is supported by a method suitable for opposing chiefly an extraneous force in the perpendicular direction.

That is, even when an extraneous force F in the perpendicular direction is suddenly applied to the platen 28 or the platen cover 18 as during the opening of the platen, the bar member 40 inserted in the holes 39 in the back of the platen cover 18 bears a force W ($W \leqq F$)

received from the platen cover, and a corresponding reinforcing effect is provided.

Accordingly, even when said extraneous force F is applied, any force which acts on the coupling portion (support portion) between the platen 28 and the printer body 22 is eliminated or mitigated, whereby deformation or damage of said portion is prevented.

Figure 7:
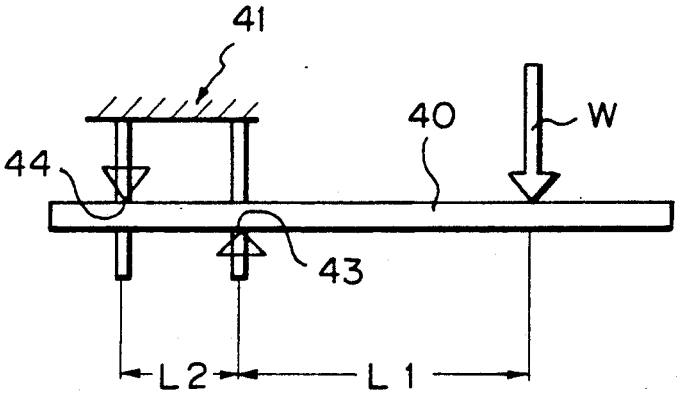

FIG. 7 schematically shows a force which acts on the bar member 40.

The force W acts on the bar member 40 by the extraneous force F applied to the platen cover 18, the distance from the acting point thereof to the fulcrum provided by the hole 43 of the support means 41 is $L_1$, and the spacing between the fulcrum provided by another hole 44 of the support means 41 and the fulcrum provided by said hole 43 is $L_2$.

In this case, the fulcrum reaction force by the hole 43 is upwardly as follows:

$$(L_1+L_2)\cdot W/L_2 \quad (1)$$

and the fulcrum reaction force by the hole 44 is downwardly as follows:

$$L_1\cdot W/L_2 \quad (2)$$

Accordingly, by adopting a structure in which the portions near the supporting holes 43 and 44 of the support means 41 are concentratedly reinforced, the coupling portion between the platen 28 and the printer body 22 can be effectively reinforced.

The embodiment illustrated has been described with respect to a case where the present invention is applied to a printer contained in an electronic desk top calculator, but the present invention is equally applicable to an electronic instrument containing a printer or like recording apparatus therein, such as a word processor or personal computer with a printer.

As is apparent from the foregoing description, according to the present embodiment, a bar member is inserted in the holes formed in the inner side of the platen cover and this bar member is supported by support means fixed in the case and therefore, there can be provided an electronic instrument with a recording apparatus which is simple and reliable in structure and in which the coupling portion between the platen and the printer body can be effectively reinforced.

FIGS. 8 to 13 illustrate a second embodiment of the present invention.

Figure 8:
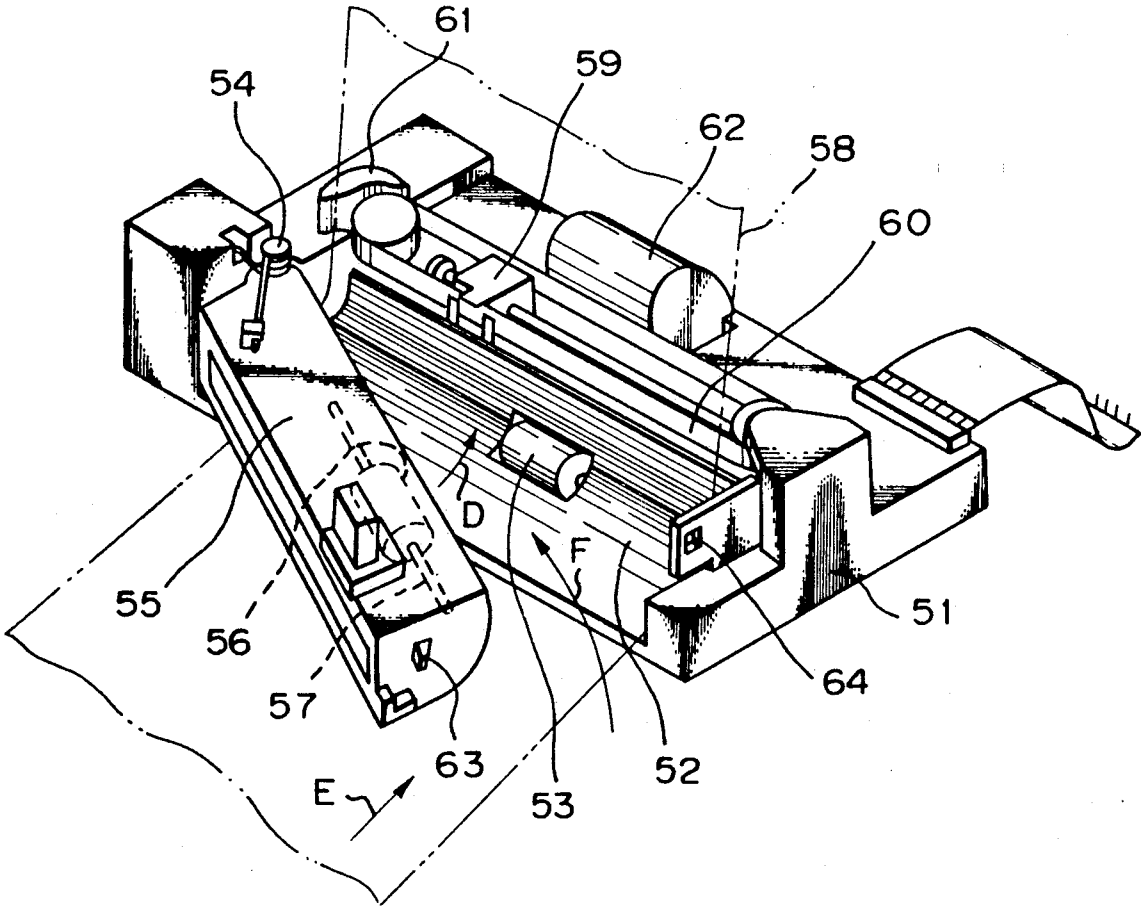
FIGS. 8 to 13 illustrate a second embodiment of the present invention, FIG. 8 being a perspective view of a recording apparatus to which this embodiment is applied, FIG. 9 being a fragmentary cross-sectional view showing a platen and a pinch roller when the platen of the recording apparatus is opened, FIG. 10 being a plan view showing the sheet loading in the recording apparatus, FIG. 11 being a fragmentary cross-sectional view showing a platen and a pinch roller when the platen of a recording apparatus according to another embodiment of the present invention is opened, FIG. 12 being an enlarged view showing the shape of the pinch roller of the recording apparatus according to this embodiment, and FIG. 13 being a fragmentary plan view of the recording apparatus.

Referring to FIG. 8, a sheet feeding roller 53 is incorporated in an opening in the substantially central portion of the sheet guide portion 52 of a body 51.

A platen 55 is openably-closably supported in the body 51 by means of a platen supporting shaft 54. FIG. 8 shows a state in which the platen is opened, and the platen may be closed and set to its usable state by being moved (pivotally moved) in the direction of arrow D in FIG. 8.

A pinch roller 56 adapted to be urged against the sheet feeding roller 53 in the closed position (set position) of the platen is mounted in the platen 55. This pinch roller is rotatably mounted by means of a pinch roller shaft 57 having its opposite ends supported by the platen 55.

On the other hand, on the body 51, there are mounted a recording head 59 movable widthwisely of a sheet (a recording medium such as paper) 58, a type belt 60 driven widthwisely of the sheet 58 by a pair of pulleys, an ink roll 61 for supplying ink to the type belt, and a drive motor 62. This drive motor drives a recording unit comprising a sheet feeding motor 53, the recording head 59, the type belt 60, etc.

The sheet 58 may usually be a roll sheet.

This sheet 58 may be set by opening the platen 55 into the position of FIG. 8, inserting the sheet 58 in the direction of arrow F from the open side of the platen 55 and loading it between a sheet guide portion 52 and the platen, thereafter closing the platen 55 and bringing a lock pawl 63 into engagement with an engagement hole 64 in the body 51.

Figure 9:
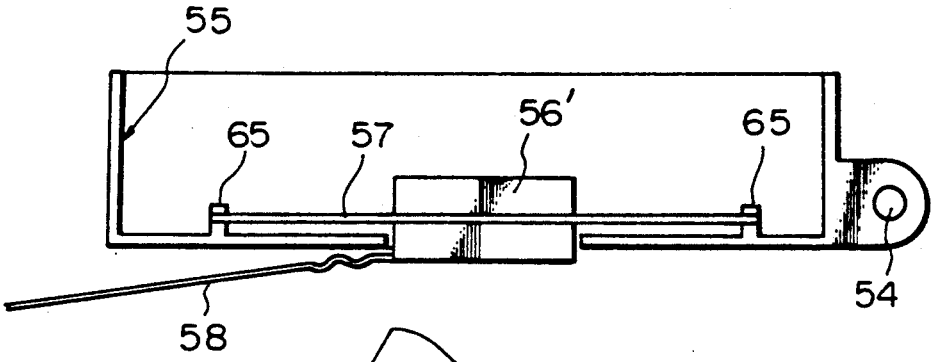
Figure 10:
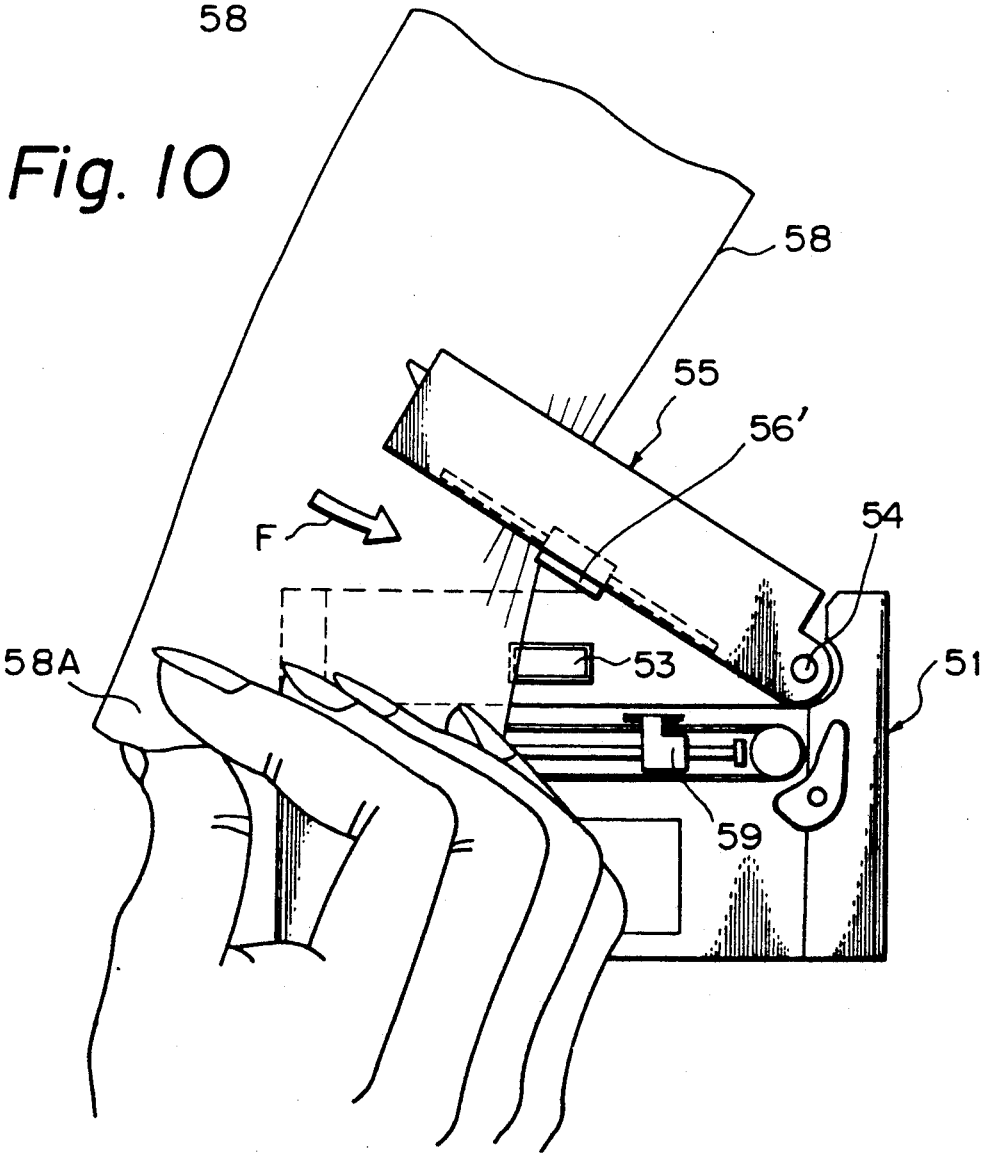

However, when the platen 55 is closed, the leading end edge of the sheet 58 may be obstructed by the side surface of the pinch roller 56' as shown in FIG. 9. That is, in FIG. 9, the loading of the sheet 58 may be accomplished by opening the platen 55, grasping the leading end portion 58A of the roll sheet 58 by a hand and inserting it in the direction of arrow F from the open end side of the platen 55.

However, in the opened position of the platen 55, the pinch roller 56' protrudes from the surface of the platen and moreover, the marginal edge of the end surface thereof is substantially at right angles and therefore, as shown in FIGS. 8 and 9, the side edge of the sheet 58 may often strike against or be caught by the marginal edge of the end surface of the pinch roller 56', and this may lead to a problem that smooth sheet loading cannot be accomplished.

The present embodiment solves this problem. That is, in FIG. 11, the platen 55 is openably-closably supported relative to the body 51 (FIG. 8) of the recording apparatus by means of the platen supporting shaft 54, and correspondingly to the sheet feeding roller 53 on the body 51 side, the pinch roller 56 is mounted on the platen.

This pinch roller 56, as in the case of FIG. 9, is mounted on the inner side of the platen 55 by means of a pinch roller shaft 57 having its opposite ends supported by hooking portions 65 and 65 and flexed by its force of pressure contact with the sheet feeding roller 53.

Figure 12:
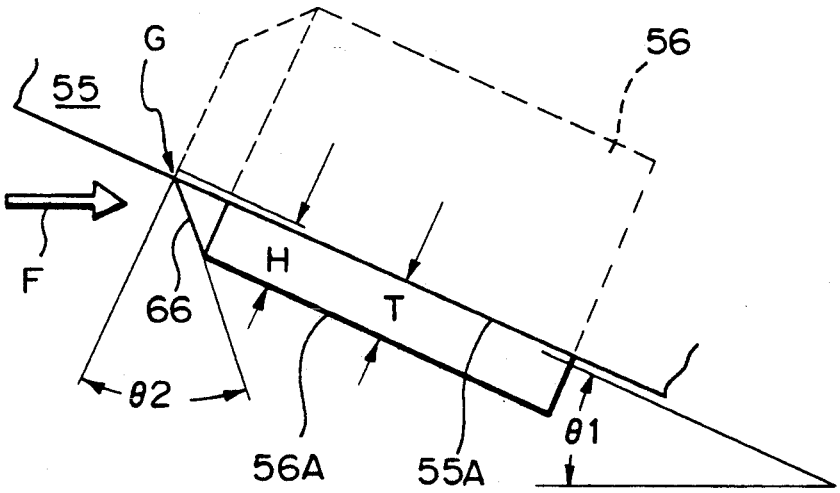

FIG. 12 is a fragmentary enlarged view of the pinch roller 56.

Figure 11:
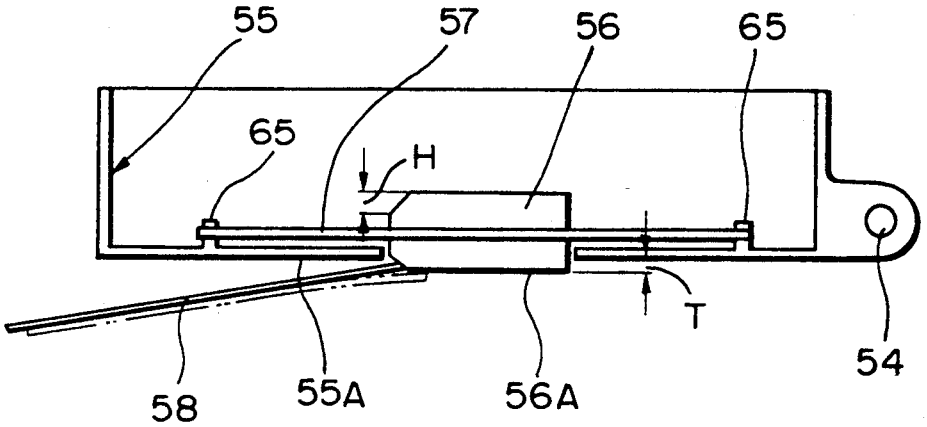

In FIGS. 11 and 12, the peripheral surface 56A of the pinch roller 56 protrudes to some extent from the surface 55A of the platen 55 when the platen is opened.

A chamfer 66 is formed on the marginal edge portion of the end surface on that side of the pinch roller 56 which is adjacent to the open end of the platen 55, that is, the opposite (left as viewed in FIG. 11) side of the platen supporting shaft 54.

The depth H of this chamfer 66 may preferably be equal to or greater than the height T at which the pinch roller 56 protrudes from the platen surface 55A.

That is, the starting point G (FIG. 12) of the chamfer 66 may preferably be on or inside the platen surface 55A, and due to such shape, the sheet 58 can readily slide in a direction indicated by dots-and-dash line and be smoothly loaded even when the side edge of the sheet 58 inserted contacts the pinch roller as shown in FIG. 11.

Figure 13:
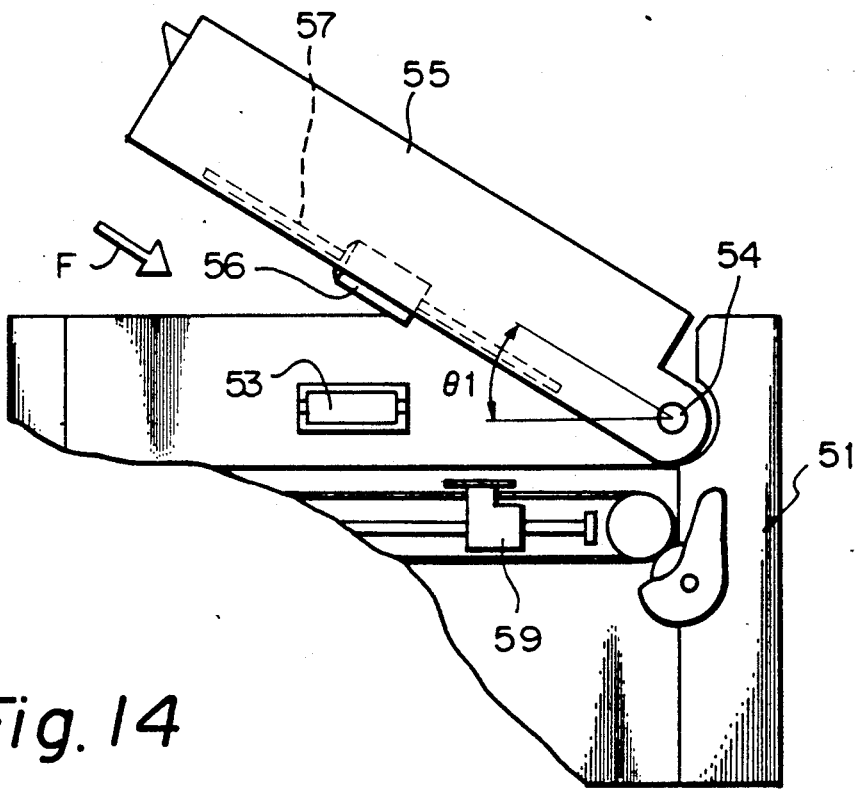

FIG. 13 is a fragmentary plan view of the recording apparatus according to the present embodiment, and shows the angle of opening of the platen 55, i.e., the angle of rotation $\theta 1$ between the opened position of the platen 55 and the set position of the platen.

In FIG. 13, reference numerals similar to those in FIGS. 8–12 designate corresponding portions.

On the other hand, in FIG. 12, the angle of the chamfer 66 of the pinch roller 56, i.e., the chamfer angle, is $\theta 2$.

This chamfer angle $\theta 2$ may preferably be greater than the angle of opening $\theta 1$ of the platen.

The reason is that by the chamfer angle $\theta 2$ being greater than the angle of opening $\theta 1$ of the platen, the sheet can readily slide along the chamfer and be more smoothly loaded without being caught even if the sheet contacts the end surface (the chamfer 66) of the pinch roller 56 when the sheet is loaded in the same direction as the direction of insertion F.

According to the embodiment described above with reference to FIGS. 11–13, in a recording apparatus wherein the platen 55 is openably-closably supported and the pinch roller 56 is mounted in the platen, the marginal edge portion of the end surface of the pinch roller which is adjacent to the open end of the platen is formed into the chamfer 66 and therefore, the possibility of the sheet 58 when loaded being caught by the pinch roller 56 can be eliminated and the sheet loading can be accomplished smoothly.

Also, the chamfer 66 is provided over the range (the protrusion height T) in which the pinch roller 56 protrudes at least from the platen surface 55A, and the chamfer angle $\theta 2$ of the pinch roller is made greater than the angle of opening $\theta 1$ of the platen 55 and therefore, even when the side edge of the sheet 58 strikes against the end surface of the pinch roller 56, the sheet can be caused to smoothly slide along the chamfer without any hindrance and thus, the sheet 58 can be loaded more smoothly.

Figure 14:
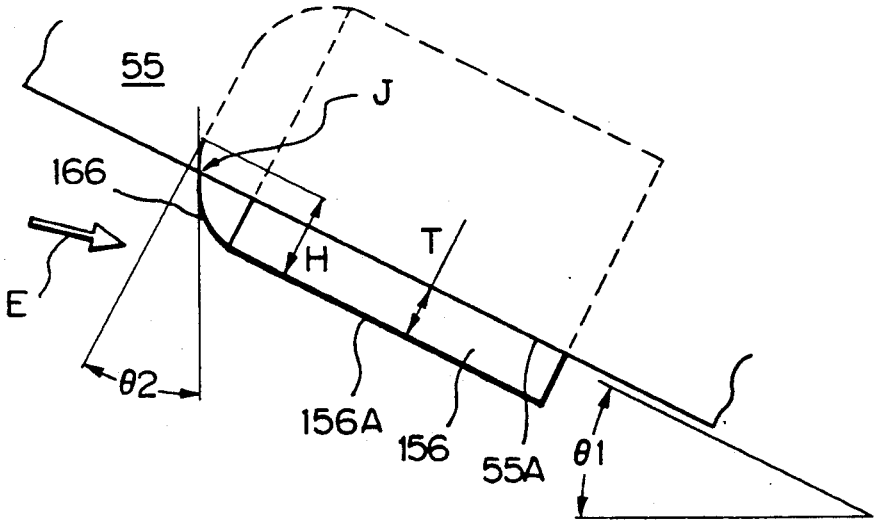
FIG. 14 is an enlarged view showing the shape of the pinch roller of a recording apparatus according to a third embodiment of the present invention.

FIG. 14 shows a pinch roller used in a recording apparatus according to a third embodiment of the present invention.

In the pinch roller 156 in the present embodiment, the chamfer 116 provided on the marginal edge portion of the end surface thereof which is adjacent to the open end of the platen 55 is in the form of an arcuate inclined surface.

The constructions of the other portions of this embodiment are substantially the same as those of the embodiment described in connection with FIGS. 8–13, and corresponding portions are designated by similar reference numerals.

In the embodiment of FIG. 14, the height H of the arcuate chamfer 166 is greater than the amount of protrusion T of the peripheral surface 156A of the pinch roller from the platen surface 55A (when the platen is opened) and the angle $\theta 2$ of the tangential line (the chamfer angle) at the point of intersection J with the platen surface 55A is set so as to be greater than the angle of opening 81 (FIG. 12) of the platen 55.

Thus, as in the case of the pinch roller 56 shown in FIG. 12, there is provided a recording apparatus in which the possibility of the sheet 58 when loaded being caught is eliminated and the sheet can be loaded smoothly.

Although in the embodiment illustrated in FIG. 14, the chamfer 116 of the pinch roller 156 is provided only on the marginal edge portion of one end surface thereof, such chamfer may be provided on the marginal edge portion of each end surface of the pinch roller to obtain the same effect.

I claim:

1. A recording apparatus for recording onto a recording sheet, said apparatus comprising:

recording means for recording onto a recording sheet;

a case member for housing said recording means;

a platen movable in a moving direction between a closed position opposite to said recording means and an open position retracted from said closed position;

a cover member for covering said platen and movable with said platen in the moving direction; and a reinforcing member contacting said cover member and extending through said cover member in a direction perpendicular to the moving direction to receive an external force which said cover member receives, said reinforcing member being cantilevered to said case member and receiving the external force whether said platen is in the open position or in the closed position and transmitting the external force to said case member, said reinforcing member being movable in the moving direction of said cover member and restricted in movement in a direction orthogonal to the moving direction of said cover member.

2. An apparatus according to claim 1, wherein said reinforcing member is positioned in a positioning hole formed on an inner side of said cover member.

3. An apparatus according to claim 1, wherein said platen is rotatable between said closed position and said open position around a rotational axis.

4. An apparatus according to claim 1, wherein said platen serves as a guide for conveying said recording sheet.

5. An apparatus according to claim 1, wherein said platen serves as a guide for guiding said recording sheet to a predetermined filling position when said platen is in said open position.

6. An apparatus according to claim 1, wherein said platen has a lock pawl and an engaging slot engageable with said lock pawl is provided on the side of the apparatus to maintain said platen in said closed position.

7. An apparatus according to claim 1, wherein said platen is always biased by a return spring to an opening direction.

8. An apparatus according to claim 1, wherein said cover member is provided on said platen.

9. An apparatus according to claim 8, wherein said recording means has a character belt and a hammer.

10. A recording apparatus according to claim 1, wherein said recording apparatus is a portable electric calculator having an indicating window and operational keys.

* * * * *

UNITED STATES PATENT AND TRADEMARK OFFICE

CERTIFICATE OF CORRECTION

PATENT NO. : 5,156,477

DATED : October 20, 1992

INVENTOR(S) : TAKESHI HASEGAWA

It is certified that error appears in the above-identified patent and that said Letters Patent is hereby corrected as shown below:

On the Title page, item [56] REFERENCES CITED - U.S. PATENT DOCUMENTS:

"Suyuki et al." should read --Suzuki et al.--;

"4,701,593 10/1989 Hiramatsu" should read --4,701,593 10/1987 Hiramatsu--.

COLUMN 1:

Line 56, "force" should read --force.--;

Line 57, "trouble." should read --problems.--.

COLUMN 3:

Line 34, "position" should read --position.--.

Signed and Sealed this

Ninth Day of November, 1993

*Attest:*

*Attesting Officer*

BRUCE LEHMAN

*Commissioner of Patents and Trademarks*